US008790224B1

(12) United States Patent
Davis

(10) Patent No.: US 8,790,224 B1
(45) Date of Patent: Jul. 29, 2014

(54) AQUATIC EXERCISE SYSTEM AND METHOD

(76) Inventor: Adam M. Davis, Miami, FL (US)

( * ) Notice: Subject to any disclaimer, the term of this patent is extended or adjusted under 35 U.S.C. 154(b) by 147 days.

(21) Appl. No.: 13/068,387

(22) Filed: May 10, 2011

Related U.S. Application Data

(60) Provisional application No. 61/395,212, filed on May 10, 2010.

(51) Int. Cl.
*A63B 31/10* (2006.01)
*A63B 31/12* (2006.01)

(52) U.S. Cl.
USPC ..... 482/111; 482/55; 482/56; 441/55; 441/56; 441/59; 441/50; 441/61

(58) Field of Classification Search
CPC ..... A63B 69/12; A63B 21/00069; A63B 21/0084; A63B 21/00065; A63B 23/12; A63B 2208/03; A63B 21/1449; A63B 2225/60; A63B 31/00; A63B 23/03508
See application file for complete search history.

(56) References Cited

U.S. PATENT DOCUMENTS 1,669,010 A * 5/1928 Natho ..... 441/57
2,771,618 A * 11/1956 Crum ..... 441/59
3,109,186 A * 11/1963 Glenn ..... 441/60
3,231,910 A * 2/1966 Tegland ..... 441/57
3,257,673 A * 6/1966 Rademacher ..... 441/57
3,786,526 A * 1/1974 Ausseil ..... 441/59
4,121,312 A 10/1978 Penney
4,411,422 A * 10/1983 Solloway ..... 482/111
4,480,829 A 11/1984 Yacoboski
4,521,011 A * 6/1985 Solloway ..... 482/111
4,565,369 A 1/1986 Bedgood
4,623,142 A 11/1986 MacKechnie
4,627,613 A 12/1986 Solloway
4,669,991 A 6/1987 Southworth
4,819,951 A 4/1989 Solloway
4,858,913 A 8/1989 Stuart
5,031,904 A 7/1991 Solloway
5,102,120 A 4/1992 Lindblad
5,266,062 A 11/1993 Runckel
5,312,278 A 5/1994 Jen
5,641,316 A * 6/1997 Bakalis ..... 441/57
5,820,530 A 10/1998 Kallassy
5,984,840 A 11/1999 Awbrey et al.
6,109,990 A 8/2000 Lundberg
6,325,727 B1 12/2001 Carr
6,342,031 B1 1/2002 Vaughan
6,672,993 B2 1/2004 Stout (Continued)

*Primary Examiner* — Loan H Thanh
*Assistant Examiner* — Andrew S Lo
(74) *Attorney, Agent, or Firm* — Benjamin M. Hanrahan; Hanrahan Law Firm, P.A.

(57) ABSTRACT

Aquatic exercise system and method for use in a body of water is presented. In particular, the system comprises a sleeve correspondingly disposable in covering relation to at least a portion of a user's appendage, such as an arm or leg, a securing assembly to secure the sleeve to a user, and at least one fin outwardly extending from the sleeve and structured to increase resistance to the user regardless of the particular directional or rotational movement. In some embodiments, the sleeve is further structured to cover an extremity of a user, such as a hand or foot. Further embodiments include a seat assembly connectable to an access pole of a pool or hot tub. The method includes applying an aquatic exercise system to an appendage of a user, submerging the appendage and system, and moving the appendage and system through water in at least one direction to create resistance.

11 Claims, 13 Drawing Sheets

(56) References Cited

U.S. PATENT DOCUMENTS

| | | | | |
|---|---|---|---|---|
| 6,962,553 | B2 | 11/2005 | Stout et al. | |
| 7,090,618 | B2 | 8/2006 | Stout et al. | |
| 7,314,433 | B2 | 1/2008 | Stout | |
| 7,435,149 | B2 | 10/2008 | Bastiao | |
| 7,478,488 | B1 | 1/2009 | Davis et al. | |
| 7,582,045 | B1 | 9/2009 | Lombardi et al. | |
| 7,621,851 | B2 | 11/2009 | Stout et al. | |
| 7,622,014 | B2 | 11/2009 | Millette et al. | |
| 2002/0077010 | A1* | 6/2002 | Lukas | 441/59 |
| 2004/0259691 | A1* | 12/2004 | Stout et al. | 482/47 |
| 2006/0189450 | A1* | 8/2006 | Stout et al. | 482/55 |
| 2006/0229168 | A1* | 10/2006 | Killgore et al. | 482/55 |
| 2009/0280703 | A1* | 11/2009 | Rachels | 441/57 |

* cited by examiner

AQUATIC EXERCISE SYSTEM AND METHOD

CLAIM OF PRIORITY

The present application is based on and a claim of priority is made under 35 U.S.C. Section 119(e) to a provisional patent application that is currently in the U.S. Patent and Trademark Office, namely, that having Ser. No. 61/395,212 and a filing date of May 10, 2010, and which is incorporated herein by reference in its entirety.

BACKGROUND OF THE INVENTION

1. Field of the Invention

The present invention is generally directed to aquatic exercise system cooperatively structured to be worn or otherwise used by an individual while performing exercises or other movements within a body of water and a method of aquatic exercise utilizing the same. In particular, the exercise system of the present invention comprises one or more sleeves, each comprising one or more fins structured and disposed to create or increase water resistance and force regardless of the direction of movement through the water.

2. Description of the Related Art

Water exercise and training is widely recognized by medical professionals as a healthy and effective way to exercise, train, and rehabilitate injuries. Specifically, the water provides a certain amount of low-impact resistance and support, allowing individuals to increase muscle strength, cardiovascular stamina, etc., without applying unnecessary negative strain on the individual's joints, muscles, bones and connective tissue.

Accordingly, aquatic-based exercise is increasing in popularity and there is a demand for effective aquatic exercise and resistance gear. In particular, many types of aquatic gear are bulky, uncomfortable, awkward, and limit the range of mobility and flexibility of the user thereof. In addition, certain equipment creates increased resistance at or near the outermost extremity portions, such as near the user's fingertips or hands, creating a large amount of negative strain on the user's wrists, ankles, and other joints and muscles. Furthermore, certain aquatic equipment is structured to provide water resistance only when the user moves his or her hands through the water in a single direction or a limited number of directions and movements.

As such, there is a need for aquatic exercise and resistance equipment that reduces negative strain on the user's wrists, ankles, and other joints and muscles, while also increasing water resistance in a 360 degree fashion and regardless of which direction or orientation the user moves his or her extremities thought the water.

SUMMARY OF THE INVENTION

The present invention is generally directed to aquatic exercise system cooperatively structured to be worn or otherwise used by an individual while performing exercises or other movements within a body of water, as well as to a method of aquatic exercise utilizing the exercise system. In particular, the system or gear of the present invention may be used while at least partially submerged within any body of water, including, but not limited to a swimming pool and/or hot tub. Specifically, water provides a greater resistance to the user, and to the gear of the present invention, than air does. In addition, the water's buoyancy effect helps minimize gravitational stress and strain commonly associated with traditional land-based exercises. This allows free range of motion, improved flexibility and reduced risk of injury. Furthermore, the temperature of the water may be varied to alleviate pain and stress on one's joints and muscles, and further to maintain the user's body temperature at an appropriate, controlled, or comfortable level.

The aquatic exercise system of the present invention provides the user with an unlimited range of motion and a multi-directional resistance, or uniform resistance in any directional or rotational movement within the water. The harder the user pushes his or her appendages and extremities and the gear of the present invention through the water, the more the water pushes back. In particular, the system of the present invention is suitable for virtually any exercise, ranging from gentle movements that aid in developing flexibility and muscle refinement, to intense movements that build muscle mass, endurance and strength.

It is also noted that use of the aquatic exercise system of the present invention in warm water, such as that found in heated pools and/or hot tubs, increases the body's circulation, and thus, the blood supply to the muscles increases. The greater the blood flow, the more nutrients that are available to help the cells and tissue regenerate. This also speeds up healing, as well as building and toning of the user's muscles. Furthermore, the use of heated or warm water with the aquatic exercise and resistance gear of the present invention is of particular benefit to those individuals who suffer from arthritis and/or stiff and painful joints. The heated water, for example, water having a temperature of up to and including one hundred and four degrees (104°), together with the gear of the various embodiments of the present invention, can be used to relax the muscles, and decrease pain and stiffness.

In addition, the aquatic exercise system and method of the present invention may be used in conjunction with athletic equipment, such as a baseball bat, golf club, tennis racket, etc., or simulated athletic equipment, such as, a pipe, tube, etc. As will be discussed in greater detail below, in at least one embodiment the sleeve of the present invention comprises a flexible, resilient webbing between the user's fingers, allowing the user to close his or her hand and effectively grip the athletic equipment or simulated athletic equipment. The user may then swing or move the athletic equipment or simulated athletic equipment though the water and experience a variable amount of resistance via one or more resistance fins.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying drawings, the present invention is directed to aquatic exercise system, generally referenced at 10. As will become apparent from the following discussion, the aquatic exercise system 10 of the various embodiments is worn or otherwise used by an individual while performing exercises or other movements within a body of water, including, but certainly not limited to a pool, hot tub, lake, river, ocean, etc. Specifically, certain portions of the system 10 are structured to provide an increased resistance and/or force as the user moves his or her appendages, such as the user's arms and/or legs, through the body of water. Moreover, the various embodiments are structured to provide multi-directional water resistance to the user regardless of which direction or orientation the user moves his or her appendages and/or extremities, such as the user's hands or feet.

Figure 1:
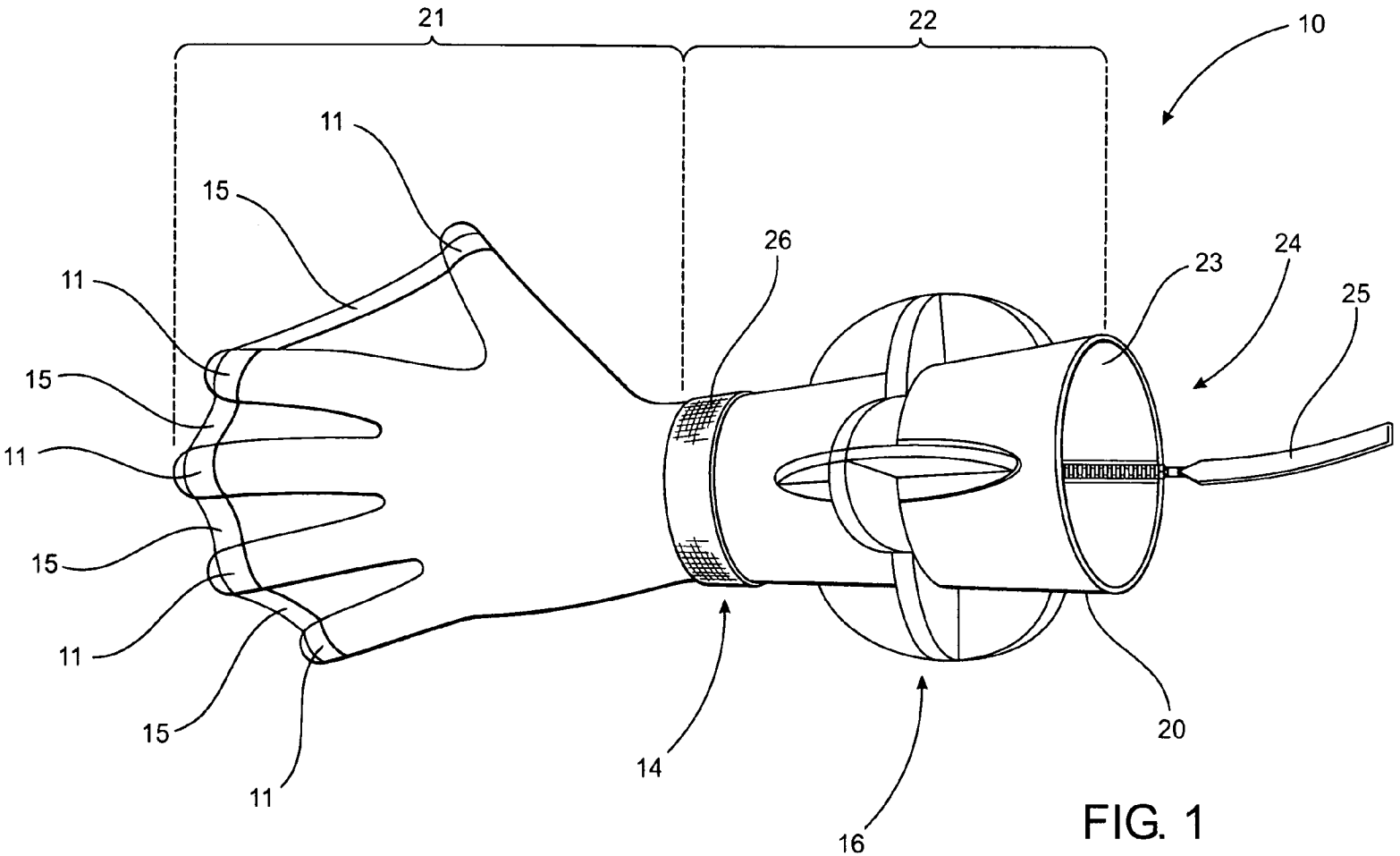
FIG. 1 is a top schematic representation of at least one embodiment of a sleeve of the present invention as disclosed here, and is structured to fit over an extremity such as a hand, in addition to an arm appendage.

In particular, as illustrated in FIG. 1, the aquatic exercise and resistance system 10 of at least one embodiment comprises a sleeve or covering 20 structured to correspondingly fit a length of an appendage, such as an arm or leg of the user. It should be appreciated that the wrist, elbow, ankle, and knee, being joints at an end or within an arm or leg, may also be included when referring to an appendage. Moreover, the sleeve 20 is cooperatively structured and disposed to removably engage and/or cover a portion of the user's appendage such as an arm or leg, but in some embodiments also covers a user's extremities such as a hand or foot. For example, in at least one embodiment, the sleeve 20 is disposable in substantially circumferentially covering relation to the appendage and/or extremity. That is, the sleeve 20 is structured to at least partially encircle the appendage, and may entirely encircle or cover the full circumference of the appendage, or any portion thereof as is appropriate and/or practical to secure the sleeve 20 to the appendage of a user. The sleeve 20 of the various embodiments disclosed herein may comprise and/or be at least partially constructed of neoprene, rubber, woven or non-woven textile materials, and/or any other material(s) cooperatively structured to facilitate the practice of the present invention in the intended manner. In at least one embodiment, the sleeve 20 is comprised of a semi-rigid material, such as plastic or other material or composition of materials that retains its shape and yet is not necessarily inflexible.

Furthermore, the sleeve 20 of at least one embodiment comprises a foreword portion 21 (first, glove portion or a first, shoe portion) structured to cooperatively fit and engage and/or be disposed in a covering relation to at least a portion of the user's extremity, such as a hand or foot. In the embodiments illustrated in the Figures, the first portion 21 is structured to cover the user's digits, such as fingers and fingertips, however, it is contemplated that the user's fingertips may be exposed through appropriately disposed openings.

Figure 2:
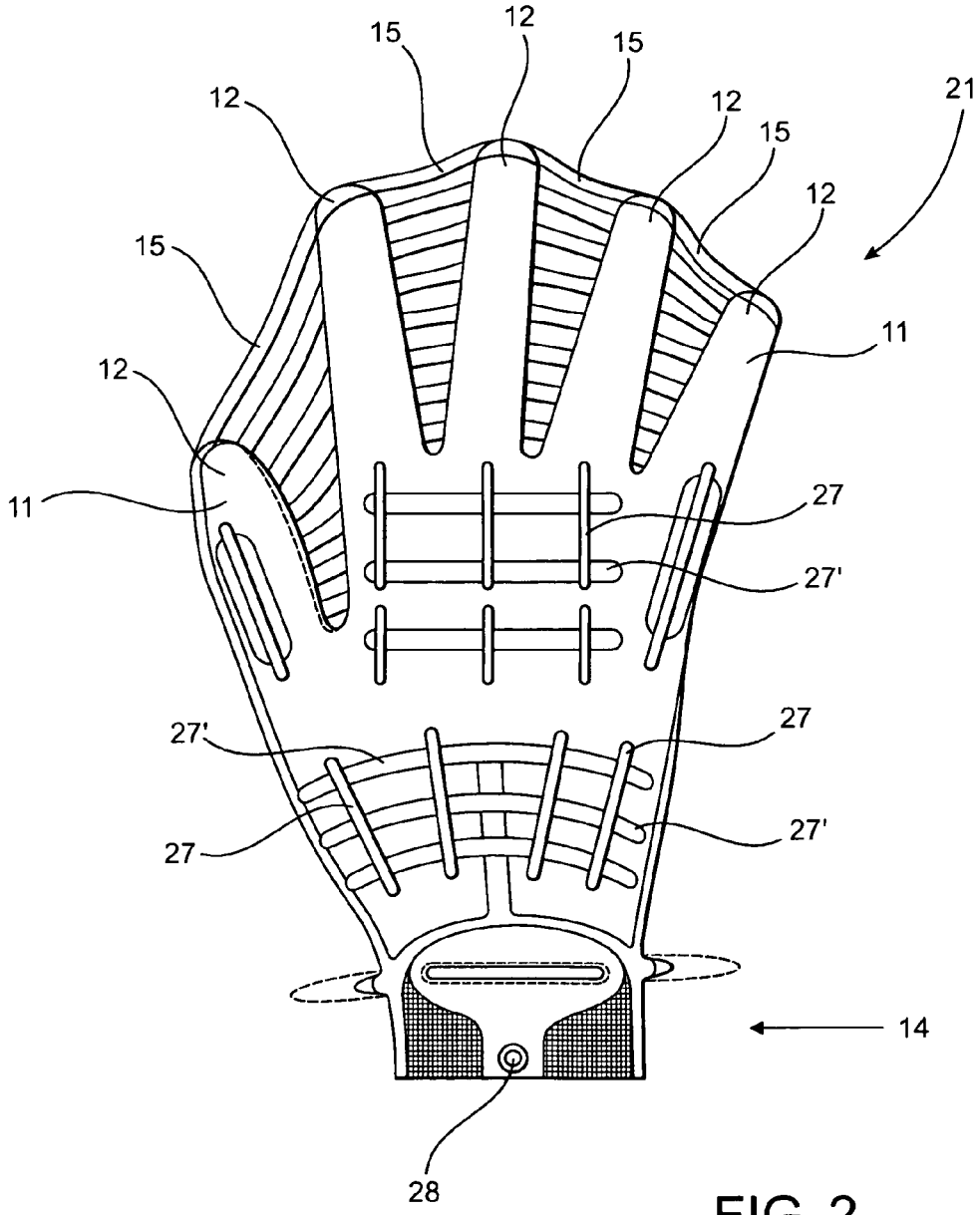
FIG. 2 is a partial top plan view of another embodiment of the sleeve of the present invention showing inflatable chambers to secure the sleeve in place.
Figure 3:
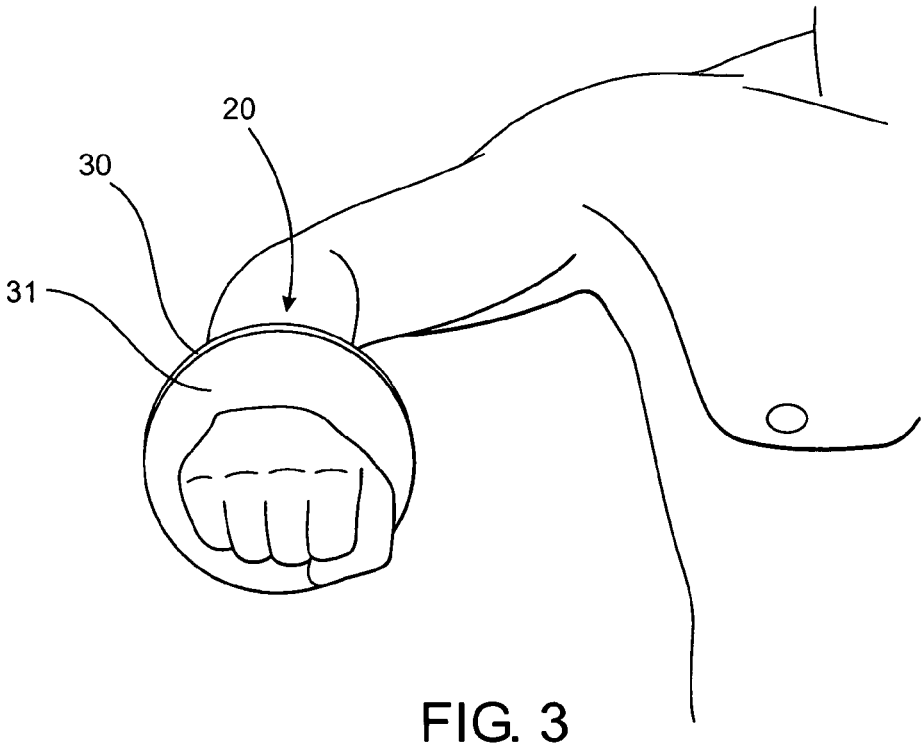
FIG. 3 is a front elevation view of yet another embodiment of the sleeve showing a disc-shaped fin.

In at least one embodiment, the sleeve 20 further comprises a flexible, resilient webbing 15 disposed at least partially between digit extensions 11 of the foreword portion 21 of the sleeve 20. The digit extensions 11 are structured to accommodate the digits, or fingers, of a user therein. The webbing 15 is structured to create drag and resistance with the water as the user moves his or her open or at least partially open hand through the water. However, the webbing 15 comprises a flexible and/or resilient material which is capable of allowing the user to move his or her fingers, and to open and close his or her hand between the open position as illustrated in FIGS. 1 and 2, and a first or closed position as best shown in FIG. 3. This provides the user with a great amount of flexibility and versatility when using the sleeve 20 of the present invention in a body of water and transitioning between certain exercise routines, some of which may require an open hand, while others may require a closed or partially closed hand. Such versatility also allows a user to mimic athletic movements, such as swinging athletic equipment, such as a bat, golf club, tennis racket, etc., and/or simulated athletic equipment, such as a pipe, tube, etc., in the water with resistance. Because of the flexible material of the webbing 15, the user may also grip the equipment to practice and/or train with the added resistance of the water and the various resistance fins of the present invention, as will be discussed in greater detail below.

Still referring to the embodiment of FIG. 1, the sleeve 20 comprises a rearward portion 22, which is cooperatively structured to engage and/or be disposed in a covering relation to at least a portion of the user's appendage, such as a forearm. In other embodiments, the rearward portion 22 may also or only cover the upper arm of a user.

In embodiments in which the sleeve 20 comprises both foreward and rearward portions 21, 22, the sleeve 20 comprise a one-piece, unitary construction, and/or the foreward and rearward portions 21, 22 are otherwise joined to one another via removable fasteners, clips, straps, hook and loop, etc., or in a more permanent or fixed manner, such as via stitching, etc. Accordingly, the second portion 22 of the sleeve 20 comprises an open end 23 cooperatively structured and disposed to allow a user to slide a portion of his or her appendage, such as the user's arm, or extremity such as the user's hand therein, and into an operative engaged position within the sleeve 20.

Further, in at least one embodiment of the present system 10, the sleeve 20 comprises a gripping portion disposed on at least a portion of the sleeve. The gripping portion comprises material such as rubber, which may be textured, or other similarly suited material that facilitates or enhances the friction between the corresponding portion of the sleeve 20 and an item the user wants to grip, hold, or make stable contact with. For instance, in one embodiment the gripping portion is disposed on the palm-side of a first portion 21 of the sleeve 20, such that a user can better grip and maintain control over an item such as athletic equipment or simulated athletic equipment as described above. In another embodiment, the gripping portion is disposed on the underside of a sleeve 60 covering the foot of a user, as described in further detail below, such that contact with the bottom surface of the body of water, such as the bottom of a pool or tub, is made more stable, and a user is less likely to slip or loose their footing, particularly while performing exercises, as described in detail hereinafter.

The sleeve 20 of at least one embodiment further comprises a securing assembly, generally referenced as 24, which is structured and disposable to removably secure the sleeve 20 in a covering and/or engaged relation to the user's appendage, such as the arm or leg, and/or extremity, such as the hand or foot. In particular, while the user moves his or her appendages and/or extremities through the body of water, a great amount of force or resistance is applied to the sleeve 20 and the various components thereof. In light of this force, the sleeve 20 must be secured to the user in a manner that will prevent or restrict the sleeve 20 from rotating, sliding, or otherwise moving from the operative orientation on the user's body. Thus, not only do the various embodiments and components of the securing assembly 24 facilitate the ease of disposing the user's appendage and/or extremity into and out of the operative position within the sleeve 20, but the securing assembly 24 is also structured to maintain the sleeve 20 in it's operative position, even during high resistance and force experienced during use within the body of water.

Specifically, the securing assembly 24 of at least one embodiment is cooperatively structured to dispose a portion of the sleeve 20 between a first, partially released and/or open orientation, and a second, at least partially closed and/or engaged orientation. For exemplary purposes only, the securing assembly 24 may comprise one or more clasping member (s) disposed along a portion of a length of the sleeve 20, and in particular, along the length of the second, rearward portion 22 thereof. Accordingly, the securing assembly 24 of at least one embodiment may comprise, for example, one or more zipper assemblies 25, hook and loop fasteners, snaps, clips, straps, buckles, etc.

Still referring to FIG. 1, the securing assembly 24 of at least one embodiment may instead or in addition comprise an elongate securing member 26 disposable at least partially, but more practically completely around a circumference of the sleeve 20, such as a section of the second, rearward portion 22, and may be disposed to engage or otherwise cover the user's wrist. In at least one embodiment, the securing member 26 comprises a flexible, elastic material, and is structured to at least partially expand or enlarge so as to allow a user to slide his or her hand and wrist therethrough. The securing member 26 will then engage the user's wrist thereby facilitating a secure engagement therein.

In yet another embodiment, the securing assembly 24 of the present invention comprises one or more inflatable chambers 27 disposed on or embedded within a portion of the sleeve 20, such as at or near the first, foreword portion 21 and/or second, rearward portion 22. In particular, the inflatable chamber(s) 27 are disposable between an at least partially or fully inflated orientation and an at least partially or fully deflated orientation. Specifically, while disposed in an inflated orientation, the inflatable chambers 27 are structured to engage an adjacent underlying portion of the user's body, for instance, the user's hand, wrist, and/or forearm.

For exemplary purposes only, FIG. 2 illustrates a plurality of elongated, longitudinal inflatable air chambers 27 and a plurality of elongated, transverse inflatable air chambers 27' disposed, positioned and/or embedded on the surface of the first, foreword portion 21 of the sleeve 20, such as the portion structured to engage the user's hand. In practice, the user will slide or otherwise dispose his or her hand into the sleeve 20, and in particular, the first, foreword portion 21 thereof, while the inflatable chambers are disposed in the at least partially deflated orientation. Once the user's hand is operatively disposed therein, the inflatable chambers 27, 27' are inflated until the user's hand is engaged thereby, or until the user's hand is comfortably and securely positioned within the sleeve 20.

In other embodiments, the inflatable chambers 27 may be positioned or embedded in virtually any location on the sleeve 20 to facilitate the practice of the present invention in the intended manner. For instance, the sleeve 20 may comprise one or more inflatable chambers 27 disposed at or near the tip 12 of the digit extensions 11, or along the second, rearward portion 22 of the sleeve 20, such as, for example, the wrist portion 14 and/or forearm portion 16.

In any event, the various embodiments that comprise one or more inflatable chambers 27 further include an inflating mechanism 28 disposed in a fluid communicative relation with the inflatable chambers 27 and structured to automatically, selectively, and/or manually dispose air, gas, liquid, or gel into the inflatable chambers as described in greater detail above. The inflating mechanism may comprise, but is not limited to, an air pumping device, and/or a valve for manually inflating the chamber(s) 27, for example, via a person's mouth and lungs.

Accordingly, the inflatable chamber(s) 27 are structured to engage the user's body at various portions along the sleeve 20 so as to securely hold the user's extremity and/or appendage therein during use within the body of water where great resistance and force is experienced. Furthermore, however, the various inflatable chamber(s) 27 are also capable of engaging or securing fingers, hands, wrists, and forearms of various sizes, lengths, and widths. Such a feature allows a single sleeve 20 of the present invention to be used and implemented by a plurality of individuals each comprising varying sized appendages and extremities. In particular, the inflatable chambers 27 may be inflated and/or deflated to appropriately, comfortably, and securely engage different sized fingers, hands, wrists, and forearms, depending upon, for instance, the particular location of the chambers 27.

Furthermore, the various embodiments of the aquatic exercise system 10 of the present invention comprises one or more fins 30 secured, attached or connected to the sleeve 20 and disposed in an outwardly extended orientation therefrom. Further, the fin(s) 30 are structured and disposed to create multi-directional resistance when the system 10 is moved through a body of water. That is to say, the fin(s) 30 are structured to provide resistance when the system 10 is moved in a plurality of directions, or one of many directions, through the water. In some embodiments, the fin(s) 30 are disposed to provide resistance in any direction of movement.

Although the fin(s) 30 may be located at or near the first, foreword portion 21 of the sleeve 20, the fin(s) 30 are preferably disposed at or proximate the second, rearward portion 22, and thus disposed in an extended orientation at or near the wrist and/or forearm portions 14, 16. Specifically, with the fin(s) 30 disposed at or near the rearward portion 22 of the sleeve 20, and thus, at or behind the user's wrists, the user has greater control over the system 10 as it is moved or dragged through the water, and less extraneous and negative strain is applied to the user's joints or wrist. The effectiveness and functionality of the sleeve 20 is thus maximized, and the likelihood of injury to the user is reduced or eliminated.

In addition, the resistance fins 30 of the various embodiments may be constructed of virtually any rigid or semi-rigid material structured to facilitate the practice of the present invention in the intended manner and structured to create resistance and/or drag when moved though a body of water. Thus, the resistance fins 30 may comprise a water-proof, water-resistant, or water-compatible plastic or plastic-like material that is structured to substantially retain its outwardly extended position or orientation when moved through water in various directions and at various speeds. Additionally, in at least one embodiment, the one or more fins 30 comprise an inflatable chamber that is disposable between an inflated or extended orientation and a deflated orientation. When inflated, the resistance fin 30 is structured to operate as described above, and create resistance and drag when moved though the body of water at various speeds and directions. The inflatable chamber of the fins 30 may thus comprise an inflating mechanism, such as an air pump or valve, which is structured to automatically, manually, or selectively inflate the chamber(s).

As illustrated in FIGS. 3 through 10, the fin(s) 30 may comprise a disc or ring extending radially outward from the sleeve 20, a longitudinal wall disposed longitudinally along at least a portion of the sleeve 20, a transverse wall disposed transversely across at least a portion of the sleeve 20, or any combination thereof. For example, referring now to FIG. 3, the resistance fin 30 of at least one embodiment comprises a substantially flat ring disposed in a circumferential relation to the sleeve 20. In particular, the fin 30 of such an embodiment comprises a substantially flat front face 31 and or rear face so as to increase the resistance and force during operative use of the sleeve 20 in a body of water.

Figure 4A:
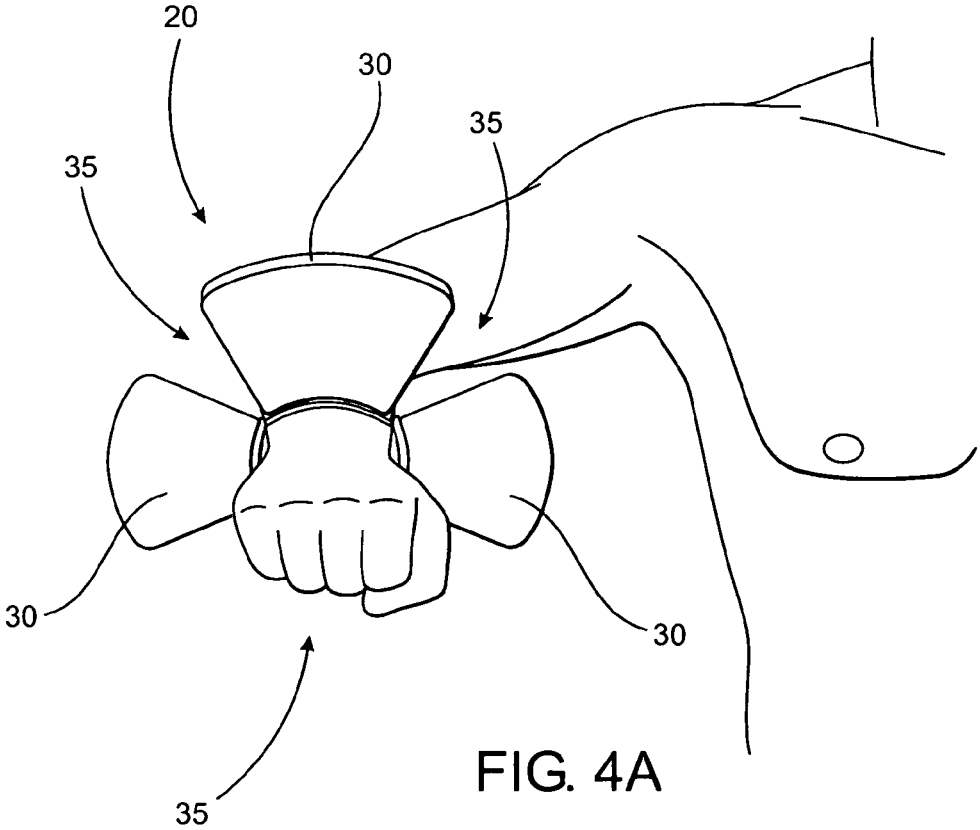
FIG. 4*a* is a front elevation view of at least one embodiment of a plurality of resistance fins as disclosed in accordance with the present invention.
Figure 4C:
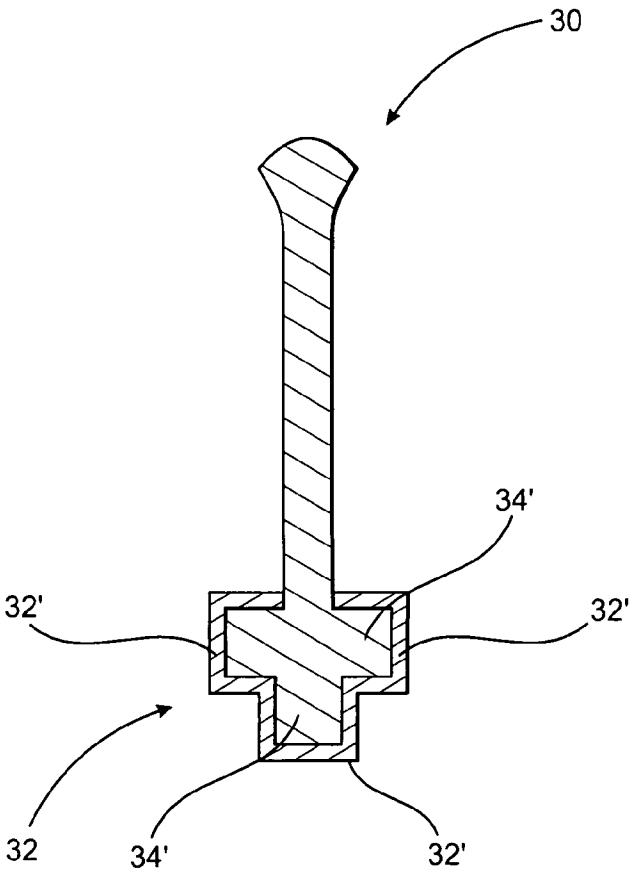
FIG. 4*c* is a side elevation view of the fin illustrated in FIG. 4*b* disposed in an interlocking relation with a cooperatively structured track.
Figure 4B:
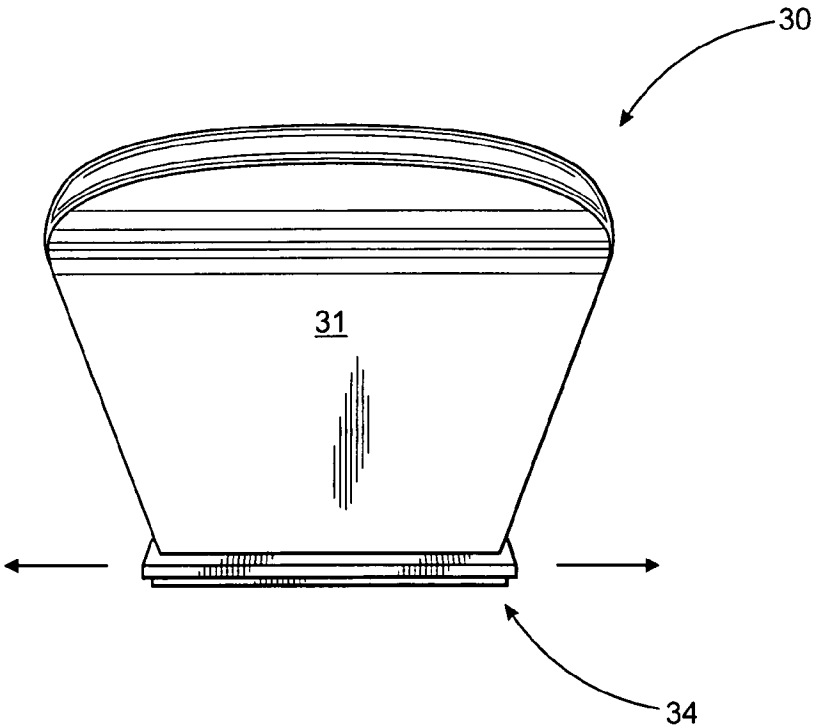
FIG. 4*b* is front elevation view of one of the fins of the embodiment illustrated in FIG. 4*a*.
Figure 5:
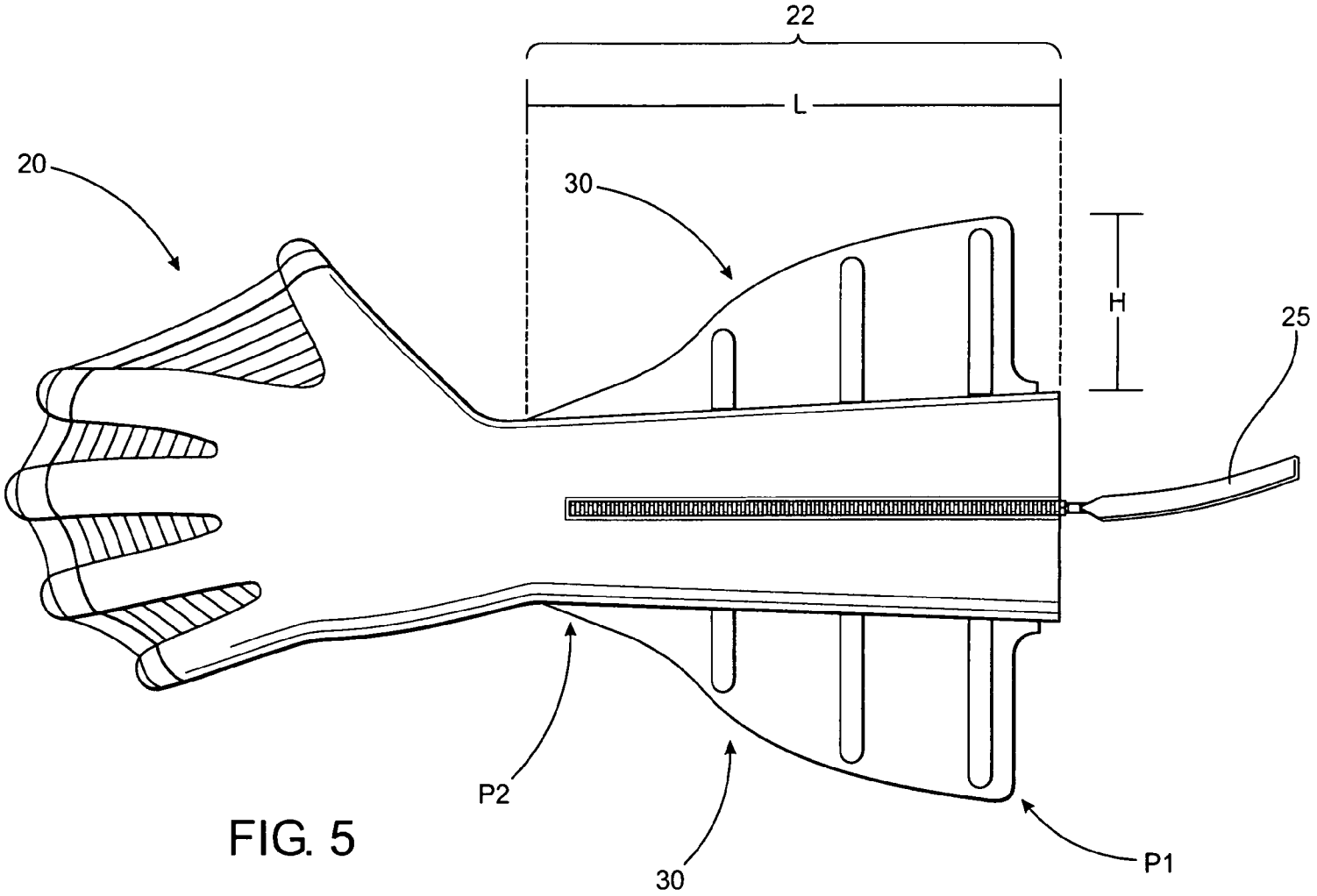
FIG. 5 is a top plan view of yet another embodiment of the sleeve as disclosed in accordance with the present invention.
Figure 6:
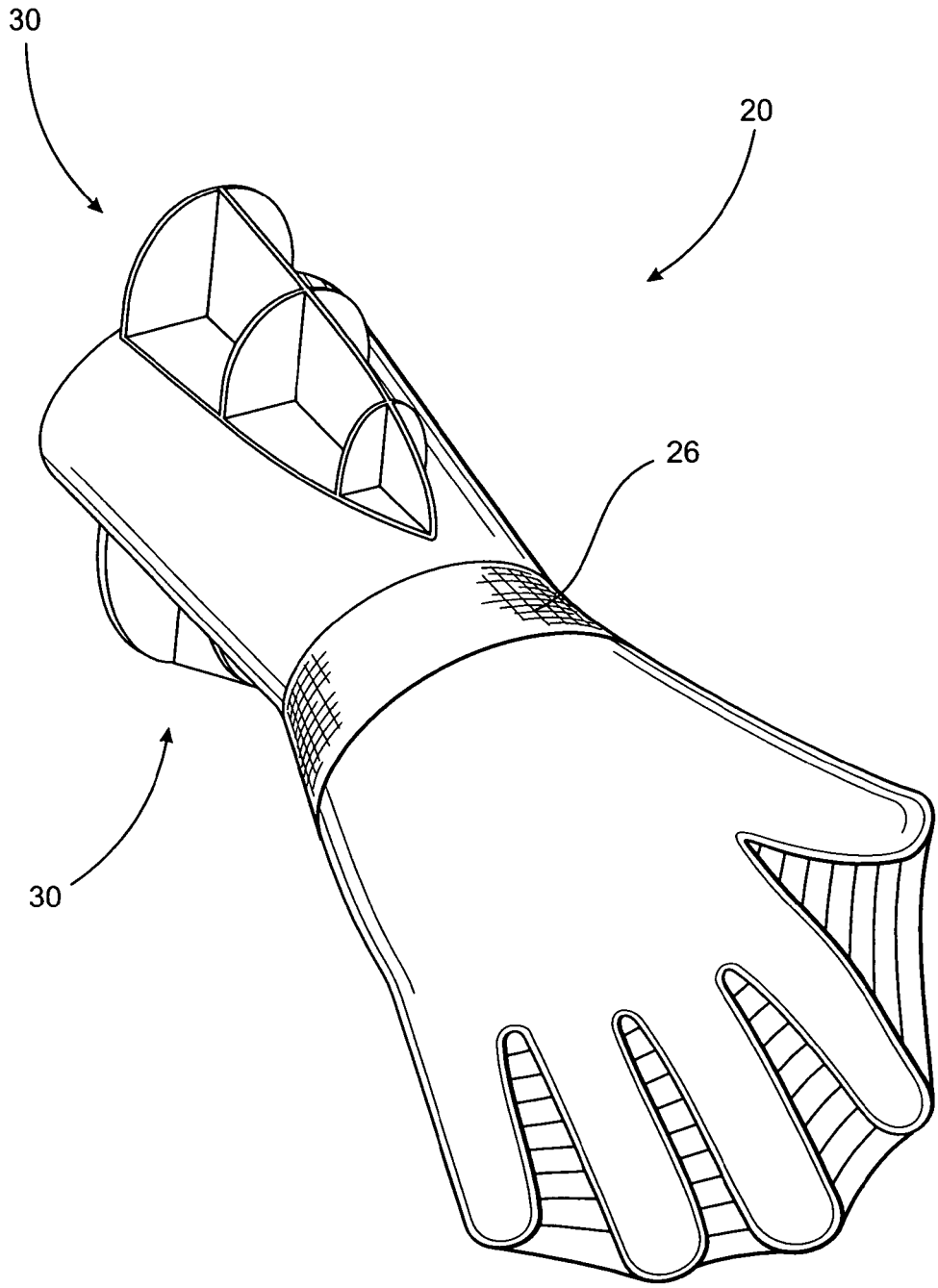
FIG. 6 is a front perspective view of the sleeve illustrated in FIG. 5.

As generally shown in the embodiment of FIGS. 4*a*-4*c*, the present invention may comprise a plurality of fins 30 which are disposed in a removable, interlocking relation with the sleeve 20. Furthermore, and as compared to the complete circumferential ring of the embodiment shown in FIG. 3, the various resistance fins 30, as shown in FIG. 4*a*, may be disposed in a substantially circumferential relation around the sleeve 20 and in a laterally spaced relation to one another, as generally referenced at 35. Accordingly, "substantially circumferential relation" as used herein means the at least one fin(s) 30 is disposed along at least a majority of the circumference of the sleeve 20. For instance, the fin(s) 30 may be disposed in continuous relation along the circumference of the sleeve 20, as in the embodiment of FIG. 3 where the fin 30 is a disc or ring. In other embodiments, the fin(s) 30 may be separated from one another and disposed in laterally spaced-apart relation, but still covering a majority of the circumference of the sleeve 20, as in the embodiments of FIGS. 4*a*-4*c*.

Additionally, still referring to FIGS. 4*a*-4*c*, at least one embodiment of the present invention further includes an attachment assembly comprising an interlocking track 32 and a cooperatively structured attachment member 34 disposed in a removable, interlocking relation or engagement with the track 32. For exemplary purposes only, the interlocking track 32 is disposed, connected, embedded, or attached along an exteriorly accessible portion of the sleeve 20, for instance, at or near the second, rearward portion 22 thereof, and may comprise a plurality of rigid grooves 32' which are structured to receive and engage cooperatively structured tongues 34' disposed on an end of the resistance fin 30. Accordingly, the various resistance fins 30 are capable of sliding, snapping, or otherwise being removably disposed in an interlocking engagement or relation with the track 21 and/or sleeve 20. As such, the present invention may comprise a plurality of variably dimensioned resistance fins 30 that may be used or secured to the sleeve 20. The fins may thus be interchangeable, and may be replaced if damaged or interchanged based upon varying degrees of difficulty and resistance. For instance, the larger the surface area is, the greater the resistance in the body of water the user will encounter when performing exercise or training routines. In addition, the various resistance fins 30 may comprise varying flexibility, porosity, slopes, contours, etc., so as to define varying degrees of difficulty. In additional embodiments, each fin(s) 30 comprises a varying height along its length, such that differing or non-uniform dimensions, shapes, sizes, and surface areas are available within a single resistance fin 30.

Additional structural variations of the resistance fins 30 are illustrated in the embodiments shown in FIGS. 5-8. For instance, each of the fins 30 of yet another embodiment comprise at least one longitudinal wall 40 extending along a length L of the rearward portion 22 of the sleeve 20, and a plurality of spaced apart transverse walls 42 positioned across and in intersecting relation with the longitudinal wall 40. In particular, the transverse walls 42 and the longitudinal wall 40 of at least one embodiment are disposed in a substantially perpendicular relation to one another. Such a configuration ensures a maximum amount of resistance in the water regardless of the direction in which the user's extremity is moving.

Further operative and structural features include a longitudinal wall comprising a varying height along its length. For example, there may be a descending or variable height H or dimension of the longitudinal wall along its length, for instance from a first rearward point P1 disposed at or proximate the user's forearm, to a second foreword point P2 disposed at or near the user's wrist. Similarly, adjacent ones of the plurality of transverse walls 42 comprise varying heights, wherein the height of each transverse wall is substantially equal to the height of the longitudinal wall at a corresponding intersecting junction J.

Figure 7:
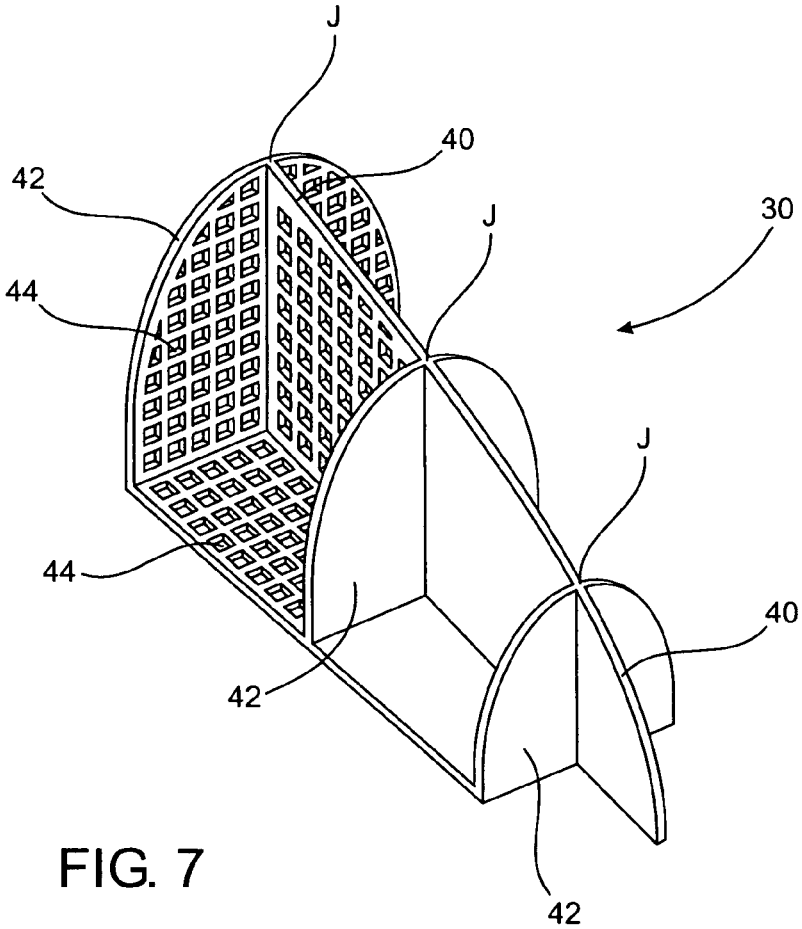
FIG. 7 is a perspective view of a structural variation of the fins illustrated in the embodiment shown in FIGS. 5 and 6.

In addition, as best shown in FIG. 7, the resistance fin 30, and in particular, the longitudinal and transverse walls 40, 42 of at least one embodiment are structured to define or otherwise comprise a plurality of ridges, indentations, dimples, or other contour elements 44 disposed on a surface thereof, creating an irregular, uneven, or waffle-like construction. When the fin 30 comprising the plurality of contour elements 44 is moved or propelled through the body of water, the contour elements 44 facilitate a turbulence effect in the water creating a greater drag and resistance, and the exercise and training for the user is thus increased. In other embodiments, these contour elements 44 are also present on fin(s) 30 disposed in other orientations beyond those depicted in FIG. 7.

Figure 8:
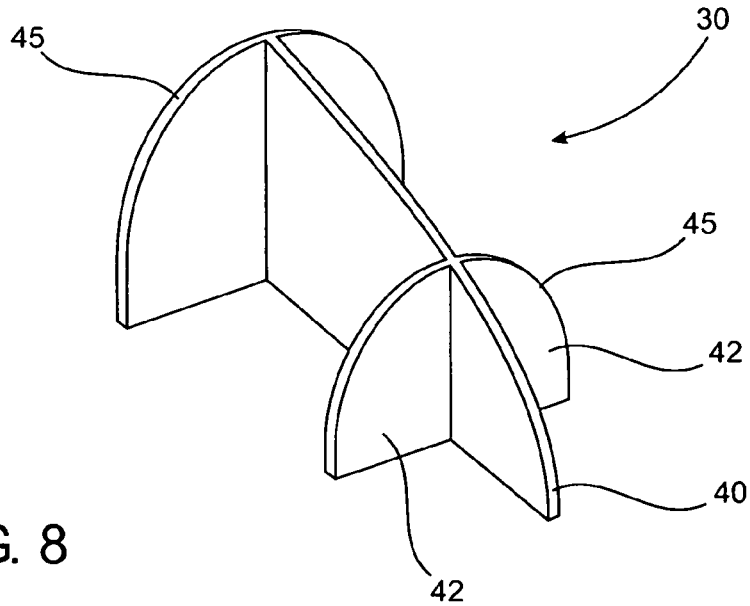
FIG. 8 is a perspective view of another embodiment of a fin as disclosed herein.

In addition, in some embodiments the contour elements 44 may comprise a plurality of small holes or protrusions disposed completely through the surface of the fin 30, allowing the water to at least partially flow there through. Such a configuration also creates or otherwise facilitates a turbulence effect in the water. Furthermore, as generally illustrated in FIG. 8, the outer edge 45 of the longitudinal and transverse walls 40, 42 may comprise a beveled, carved, curved or otherwise non-angular lip which is also structured to increase turbulence as the water is displaced or moved by the fin 30.

Figure 9:
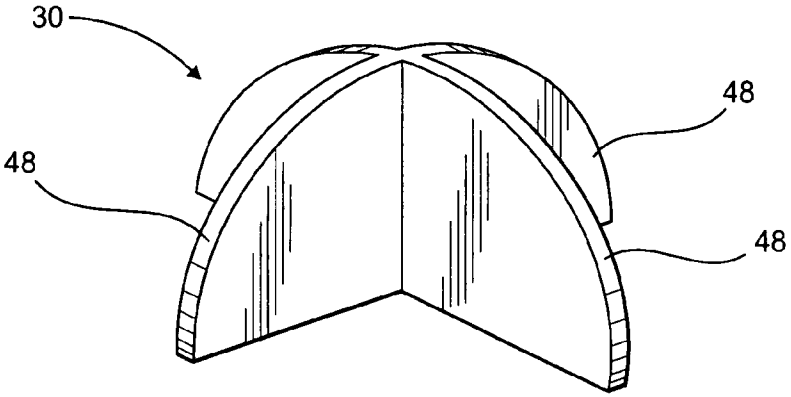
FIG. 9 is a perspective view of another embodiment of a fin as disclosed herein.
Figure 10:
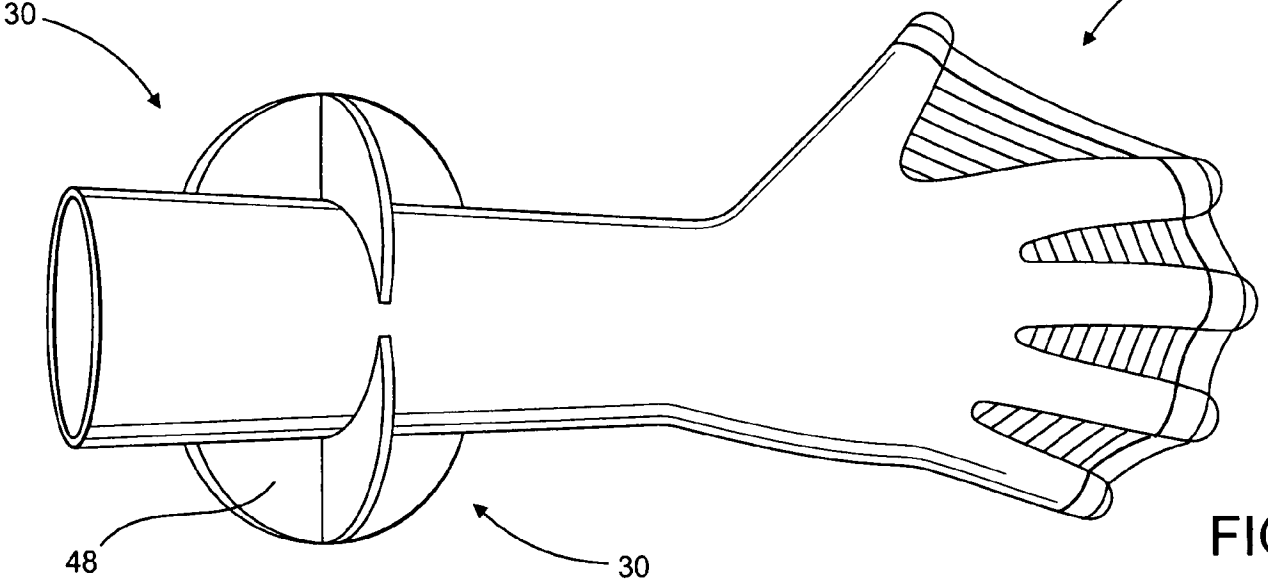
FIG. 10 is a top plan view of a sleeve with the fins illustrated in FIG. 9.

FIGS. 9 and 10 illustrate various structural features of yet another embodiment of the present invention. In particular, the resistance fins 30 may comprise two similarly structured and dimensioned walls 48 disposed in a cross or substantially "X" shaped pattern and connected either fixedly or removably to one or more portions of the sleeve 20. For instance, the sleeve 20 may comprise a plurality of connectors, including but not limited to, snaps, buttons, etc., disposed thereon. The plurality of connectors are cooperatively structured to be removably connected to another connector disposed or positioned on the bottom portion of a corresponding resistance fin 30. In such an embodiment, the user may choose where on the sleeve 20 to connect the one or more resistance fins 30.

Figure 11:
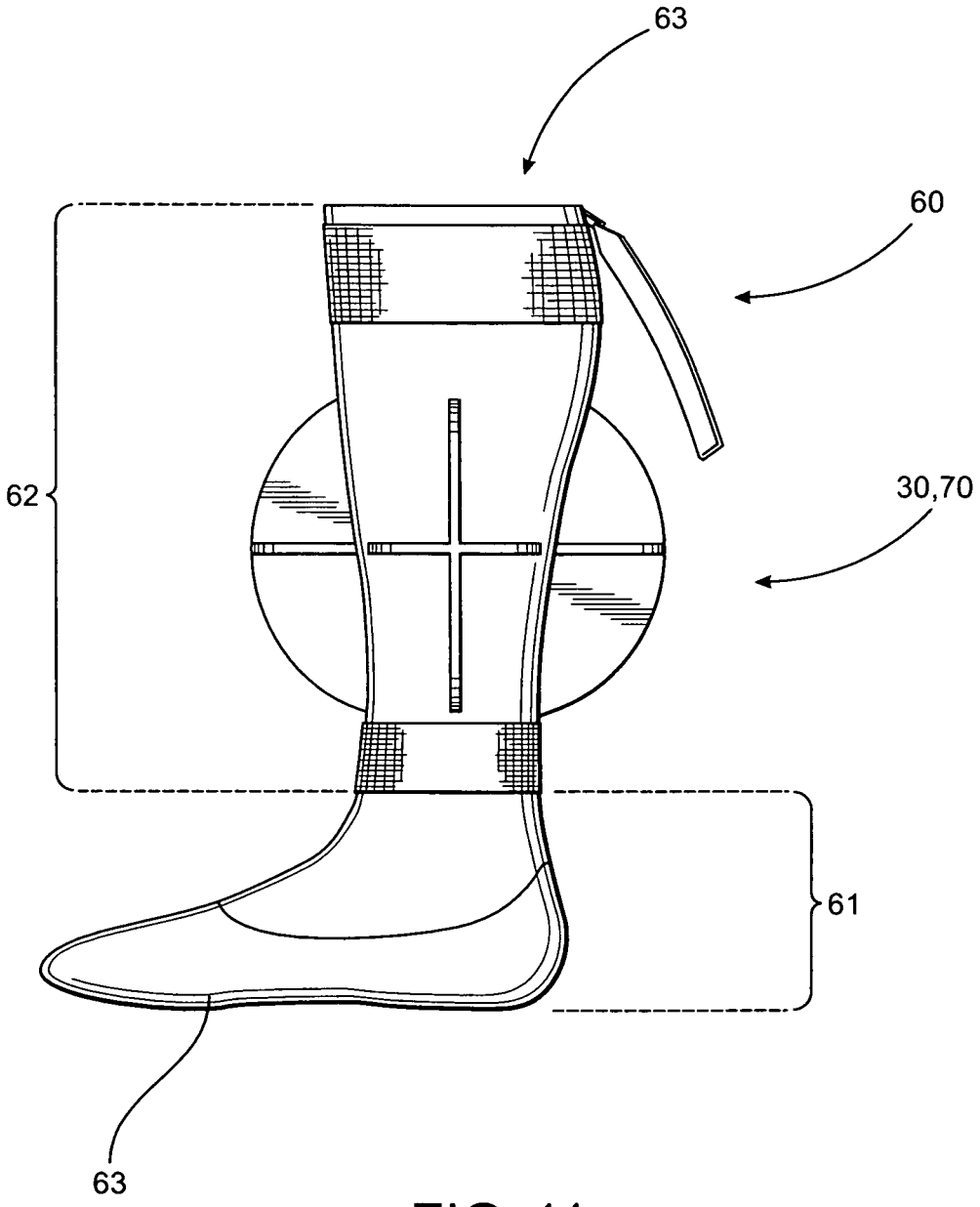
FIG. 11 is a side elevation view of a sleeve as disclosed in accordance with at least one embodiment of the present invention, and is structured to fit over an extremity such as a foot, in addition to a leg appendage.
Figure 12:
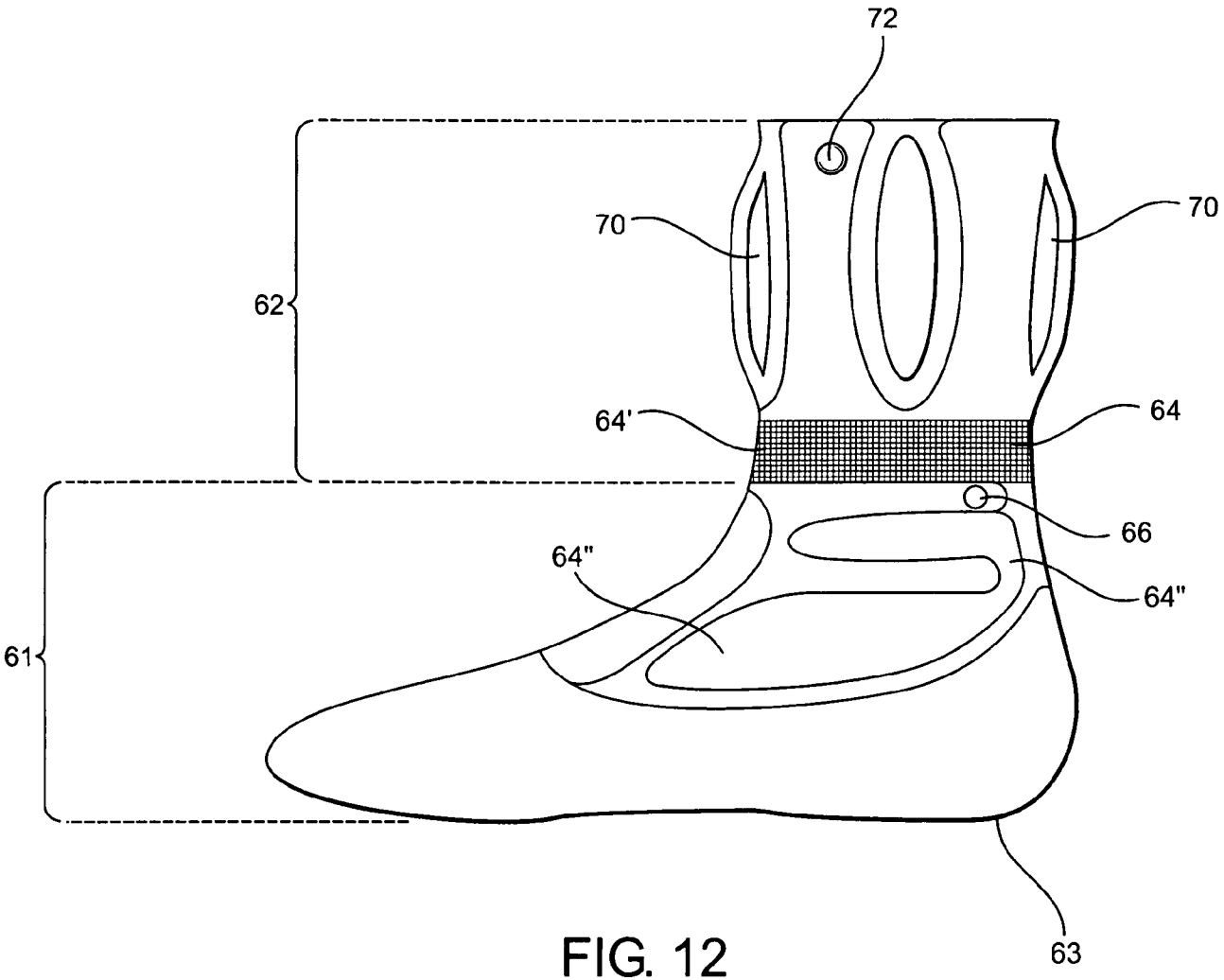
FIG. 12 is a partial side elevation view of another embodiment of the sleeve as disclosed herein.

As shown in FIGS. 11 and 12, the aquatic exercise system 10 may be disposed on a leg and/or foot of a user. Accordingly, and as similarly described above in relation to an arm and/or hand, the present invention comprises a sleeve or covering 60 cooperatively structured and disposed to removably engage and/or cover a portion of the user's leg, such as calf or thigh, and may encompass the ankle and knee. In additional embodiments, the sleeve 60 is further structured to correspondingly fit and is disposable in covering relation to an extremity, such as a foot. Specifically, in such embodiment the sleeve 60 comprises a lower or first, shoe portion 61 cooperatively structured to engage or be disposed in an at least partially covering relation to the user's foot. Moreover, the lower portion 61 is structured to fit over the user's foot like a shoe or sandal, and in some embodiments comprises a textured gripping member disposed on an undersurface or sole 63 thereof. The gripping member of at least one embodiment comprises a textured rubber or other material cooperatively structured to facilitate a gripping relation with a floor or bottom of a body of water, including a pool, hot tub, etc.

Still referring to FIG. 11, the sleeve 60 comprises an upper or second, leg portion 62, which is cooperatively structured to engage and/or be disposed in a covering relation to at least a portion of the user's calf, ankle, thigh, and/or knee. Similar to the sleeve 20 for an arm, described above, the lower and upper portions 61, 62 of the sleeve 60 for a leg of at least one embodiment comprises a one-piece, unitary construction, and/or are otherwise joined to one another via removable fasteners, clips, straps, hook and loop, etc., or in a more permanent or fixed manner, such at via stitching, etc. The upper portion 62 therefore comprises an open end 63 cooperatively structured and disposed to allows a user to slide a portion of his or her outer extremity and/or appendage, such as the user's foot, ankle, calf, knee, and/or thigh, therein and into an operative, engaged position within the sleeve 60.

Also similar to the arm sleeve 20 described above, the leg sleeve 60 of at least one embodiment comprises a securing assembly 64 which is structured and disposed to removably secure the sleeve 60 in a covering and/or engaged relation with the user's leg, such as calf, ankle, knee, or thigh. The securing assembly 64 may comprise a plurality of clasps, loops, straps, buckles, hook and loop fasteners, zippers, etc. In addition, the securing assembly 64 may comprise a flexible, elastic ankle member 64' disposed at least partially, but most practically completely around a circumference of a section of the second, upper portion 62 disposed to engage or at least partially cover the user's ankle.

In yet another embodiment, however, the securing assembly may comprise one or more inflatable chambers 64" disposed on or embedded within the sleeve 60. Similar to the inflatable chamber(s) 27 disposed on the hand sleeve 20, described above, the inflatable chamber(s) 64" disposed in the foot sleeve 60 are capable of being appropriately inflated and deflated so as to comfortably and securely disposed a user's extremity within the sleeve 60. As such, at least one embodiment comprises an inflating mechanism 66, such as an air pump or valve structured to facilitate the automatic, selective, or manual inflation and/or deflation of the various inflatable chambers 64".

Furthermore, the various embodiments of the sleeve 60 comprise one or more fins 70 secured, attached, or connected to the sleeve 60 and disposed in an outwardly extended orientation therefrom. Although the resistance fins 70 may be located at or near the lower portion 61, the fins 70 are preferably disposed at or proximate the upper portion 62, as illustrated in FIG. 12, and thus disposed in an extended orientation at or near the user's ankle and/or calf. Such a configuration allows for greater control and less extraneous strain on the user's ankle joints and muscles.

Similar to the resistance fins 30 described above in relation to the arm sleeve 20, the resistance fins 70 may be constructed of virtually any material with is structured to substantially retain its outwardly extended position or orientation when propelled though the body of water in various directions. Thus, the fins 70 may comprise a rigid or semi-rigid plastic and/or an inflatable chamber that may be inflated and/or deflated. Accordingly, the present invention may further comprise an inflating mechanism 72 such as an air pump or valve.

In addition, it is also contemplated that the various embodiments of the resistance fins 70 associated with and/or connected or secured to the sleeve 60 may comprise any of the various structures and configurations as described in relation to the resistance fins 20 shown in FIGS. 3-10.

Figure 13:
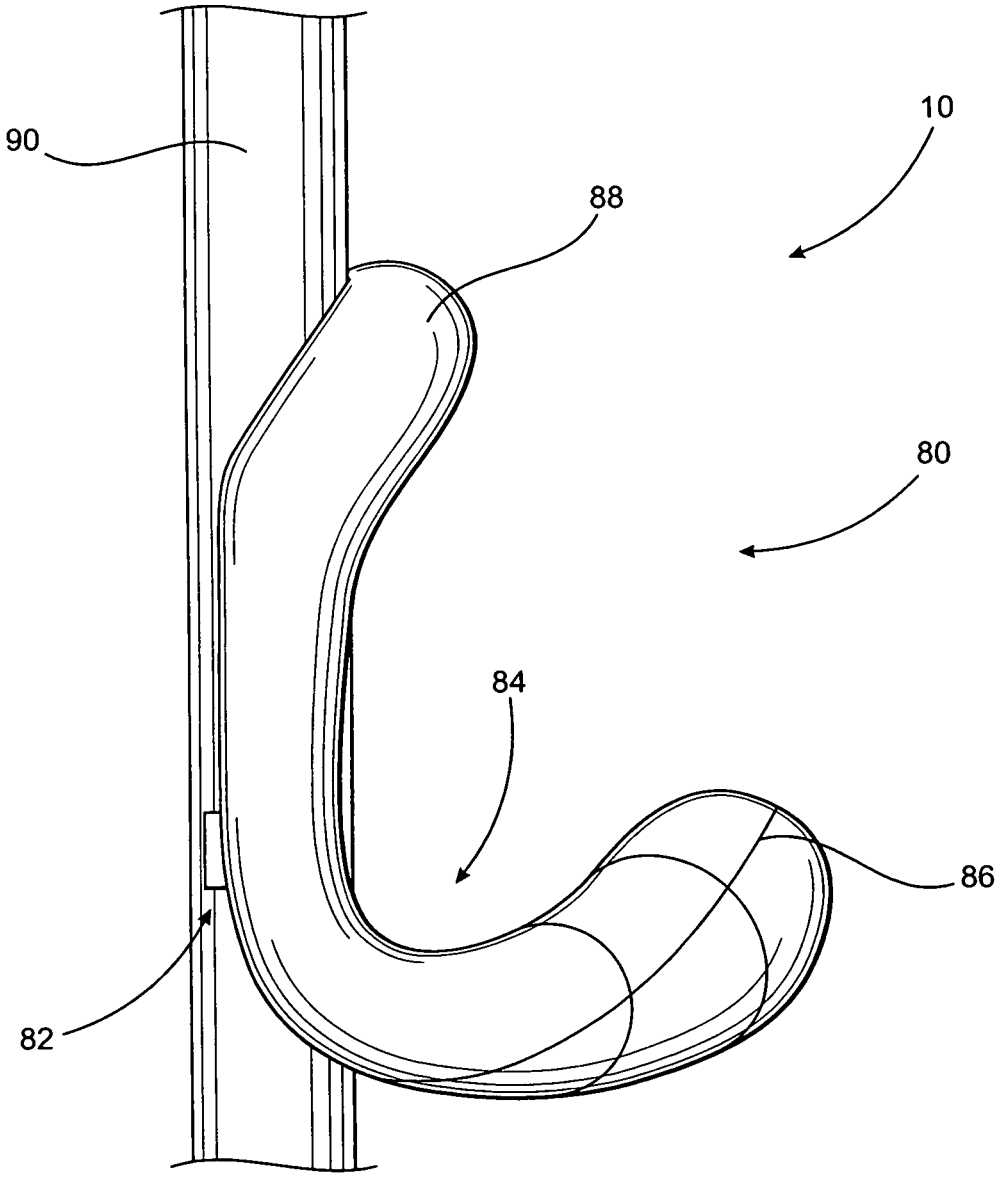
FIG. 13 is a side elevation view of the seat assembly as disclosed in accordance with at least one embodiment of the present invention.
Figure 14:
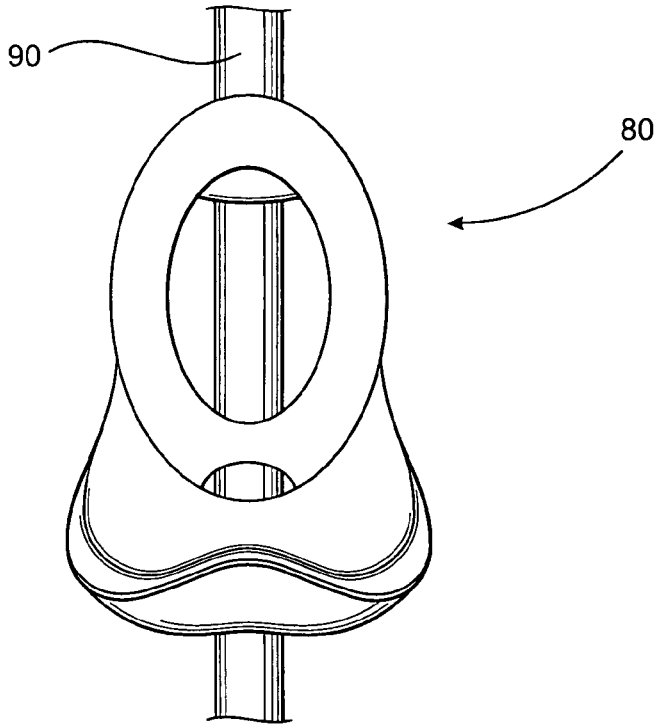
FIG. 14 is a front elevation view of the seat assembly as illustrated in FIG. 13.
Figure 15:
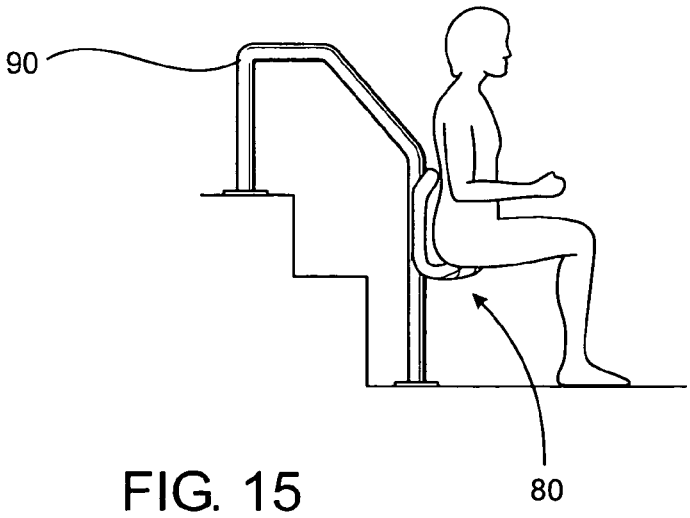
FIG. 15 is a side elevation view of a user operatively disposed in the seat assembly illustrated in FIGS. 13 and 14.

Referring now to FIGS. 13-15, in some embodiments the aquatic exercise system 10 of the present invention further comprises a seat assembly 80 structured to support a user in a seated position and further structured to be removably attachable to an access pole 90. For example, most pools, hot tubs, etc. comprise one or more poles, posts, or rods that are generally located at or near an entrance to the body of water, such as, near a set of stairs or ladder leading into the water. The seat assembly 80 of the present invention comprises an attachment assembly, generally references as 82, which is structured to securely attach the seat assembly 80 to the pole 90, and is removably connectable in a secure and sturdy relation to the pole 90. In particular, the attachment assembly 82 of the various embodiments may comprise on or more clips, straps, clamps, snaps, etc. which are capable of securely holding the seat assembly 80 to the pole 90.

As attached, the seat assembly 80 is structured to be disposable in suspended relation at least partially within the body of water, at least while the attachment assembly is connected and/or secured to the pole 90. For instance, the seat assembly 80 may be completely or partially submerged in the water when secured to the pole. Moreover, when in use, the seat assembly 80 is sufficiently submerged to allow the portion of an appendage of a user who is positioned in the seat assembly 80 and to which the remainder of the aquatic exercise system 10 is applied to be also submerged in water.

As illustrated in FIG. 13, the seat assembly of at least one embodiment comprises a heel cup 84 disposed between a seat portion 86 and a lumbar support 88. As best shown in the schematic illustration of FIG. 15, the user is thus able to comfortably, and securely sit on the seat assembly 80 and perform certain exercises, routines, or training, for instance, while wearing the sleeves 20, 60 with fins 30, 70 as described herein.

The present invention also comprises a method of aquatic exercise, generally depicted schematically as 100. Specifically, a user may perform a plurality of exercises and routines using the various aquatic exercise system 10 of the various embodiments as disclosed and described herein, while at least partially submerged in a body of water. For example, a user can perform the steps of a "Liquid Chiropractor" exercise routine while using the various sleeves 20, 60 disclosed herein. In general, the "Liquid Chiropractor" involves rotation of the user's arms from side to side while submerged in the body of water. In addition, the "Bear Hug with Squat" can be performed. This routine generally comprises movement of the user's arms within the body of water, while simultaneously performing squats. Similarly, a user may perform a "Bear Hug" without the squats while at least partially submerged in the water. In another example, a user performs "Scissor Kicks" and "Twists" with the user's legs and feet submerged in the body of water. Such a routine requires a user to kick his or her feet in an alternating fashion. Also, a user may perform a "Bicycle" exercise routine in the water with the present invention.

Of course the exercise routines described above are mere examples and should not be viewed as limiting in any manner. In any event, as described herein, various embodiments of the aquatic exercise and resistance gear 10 of the present invention are structured to increase the resistance and quality of the particular exercises performed in the body of water.

Figure 16:
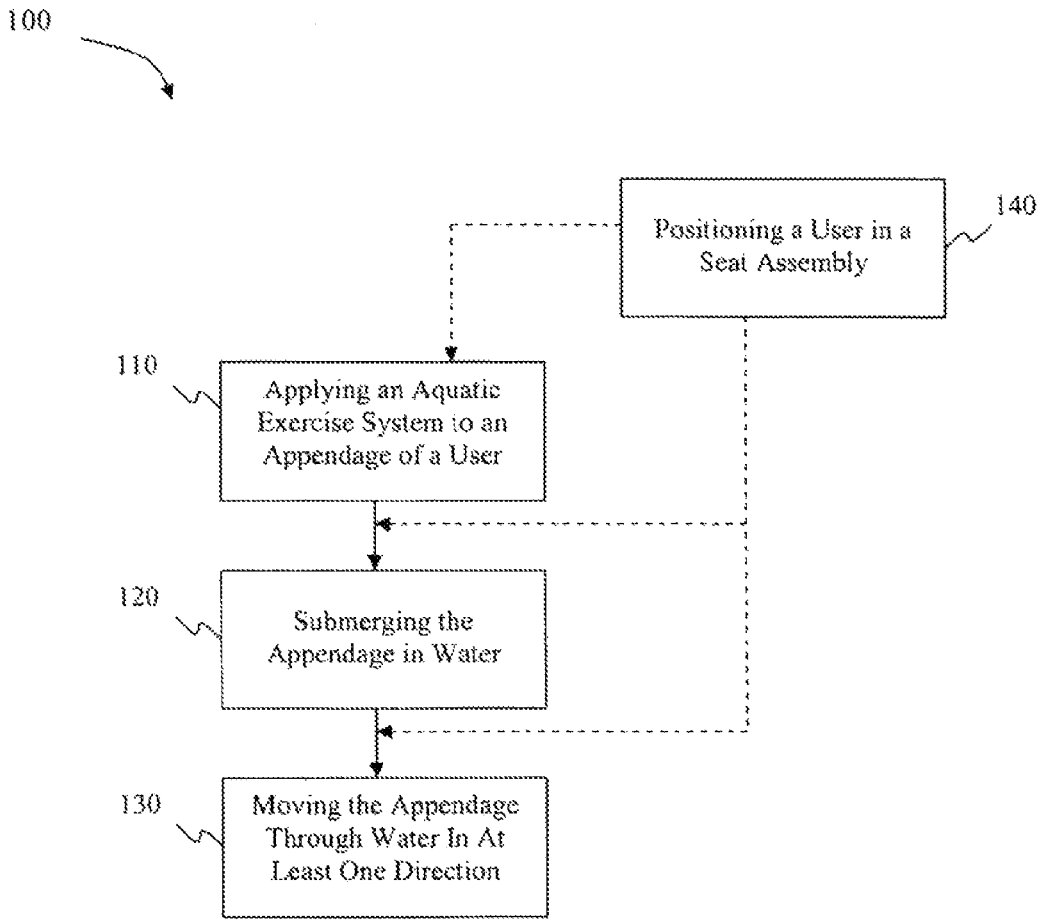
FIG. 16 is a schematic representation of the method of aquatic exercise of the present invention.

With particular reference to FIG. 16, the method of aquatic exercise, as at 100, utilizes the aquatic exercise system 10 as described above. Specifically, the method 100 comprises applying an aquatic exercise system to at least one appendage of a user, as at 110. Applying the system to an appendage occurs generally as described above, such as by inserting an extremity or portion of an appendage through an open end of the sleeve of the system, and sliding, moving, or otherwise positioning the sleeve along the appendage and/or extremity until the desired location is achieved. Once the desired location is achieved, the securing assembly is engaged to secure and retain the sleeve in place as positioned.

The method 100 also comprises submerging at least a portion of the appendage utilizing the aquatic exercise system in water, as at 120. That is, the portion of the appendage and/or extremity that is covered by the sleeve is at least partially submerged in water, at least enough so that the fin of the system is sufficiently submerged so as to create resistance when moved through the water. It should be understood that in at least one embodiment, the fin(s) are entirely submerged in water in the present method 100, however, the fin(s) can just as readily be only partially submerged for the present method 100 so long as resistance is created when moved through the water.

The method 100 also comprises moving the appendage utilizing the aquatic exercise system through the water in at least one direction, as at 130. As can be appreciated from the description of the system above and the Figures, the appendage can be moved in any direction, such as a series of directions, a back-and-forth motion, or a plurality of directions. Examples of appropriate movements include, but are not limited to, the exercises described above. The movement of the appendage and the corresponding exercise system through the water creates resistance and provides exercise such as strength training, etc. as described above.

In at least one embodiment, the method 100 further comprises positioning a user in a seat assembly that is securely suspended at least partially within a body of water, as at 140. It should be readily understood that a user may position him/herself in the seat assembly, or a caretaker, therapist, or other person may position the user in the seat assembly, such as if the user is incapable of moving themselves or one or more of their limbs. It should also be appreciated that positioning a user in a seat assembly, as at 140, can occur at any step in the present method 100, but preferably occurs prior to moving an appendage utilizing the exercise system through water, as at 130.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An aquatic exercise system for applying multi-directional resistance to a user's arms and legs, said system comprising:

two arm sleeves disposable in substantially covering relation to the user's hands and a portion of the user's arms, each of said arm sleeves comprising a first, glove portion and a second, rearward portion, wherein said second, rearward portion is disposable in an at least partially engaging relation with the user's forearm, each of said arm sleeves further comprising at least one fin secured to said second, rearward portion of said arm sleeve and disposable in an outwardly extending relation between the user's wrist and the user's elbow, wherein said at least one fin disposed on said arm sleeves comprises at least one longitudinal wall extending along a length of said arm sleeves and a plurality of spaced apart transverse walls disposed in intersecting relation with said at least one longitudinal wall, two leg sleeves disposable in a substantially covering relation to a portion of the user's feet and legs, each of said leg sleeves comprising a first, shoe portion and a second, leg portion, wherein said second, leg portion is disposable in an at least partially engaging relation with the user's calf, each of said leg sleeves further comprising at least one fin secured to said second, leg portion of said leg sleeve and disposable in an outwardly extending relation between the user's ankle and the user's knee, and wherein said fins disposed on said arm and leg sleeves are further structured and disposed to create multi-directional resistance when said aquatic exercise system is moved through a body of water.

2. The aquatic exercise system as recited in claim 1 wherein said arm sleeves further comprise a flexible, resilient webbing disposed at least partially between a plurality of digit extensions.

3. The aquatic exercise system as recited in claim 1 wherein said arm sleeves comprise a gripping portion disposed on said first, glove portion of said arm sleeves.

4. The aquatic exercise system as recited in claim 1 wherein said at least one longitudinal wall comprises a varying height along its length.

5. The aquatic exercise system as recited in claim 4 wherein each of said plurality of traverse walls are adjacent to one another and comprise varying heights.

6. The aquatic exercise system as recited in claim 5 wherein the height of each of said plurality of transverse walls is substantially equal to the height of said at least one longitudinal wall at a corresponding intersecting junction.

7. An aquatic exercise system for applying multi-directional resistance to a user's arms and legs, said system comprising:

two arm sleeves disposable in substantially covering relation to the user's hands and a portion of the user's arms, each of said arm sleeves comprising a first, glove portion and a second, rearward portion, wherein said second, rearward portion is disposable in an at least partially engaging relation with the user's forearm, each of said arm sleeves further comprising a fin secured to said second, rearward portion of said arm sleeve and disposable in an outwardly extending relation between the user's wrist and the user's elbow, wherein said fin comprises a single disc-shaped fin circumferentially disposed around said entire sleeve and positioned behind the user's wrist, two leg sleeves disposable in a substantially covering relation to a portion of the user's feet and legs, each of said leg sleeves comprising a first, shoe portion and a second, leg portion, wherein said second, leg portion is disposable in an at least partially engaging relation with the user's calf, each of said leg sleeves further comprising at least one fin secured to said second, leg portion of said leg sleeve and disposable in an outwardly extending relation between the user's ankle and the user's knee, and wherein said fins disposed on said arm and leg sleeves are further structured and disposed to create multi-directional resistance when said aquatic exercise system is moved through a body of water.

8. An aquatic exercise system for applying multi-directional resistance to a user's arms and legs, said system comprising:

two arm sleeves disposable in substantially covering relation to the user's hands and a portion of the user's arms, each of said arm sleeves comprising a first, glove portion and a second, rearward portion, wherein said second, rearward portion is disposable in an at least partially engaging relation with the user's forearm, each of said arm sleeves further comprising at least two disconnected fins secured to said second, rearward portion of said arm sleeve and disposable in an outwardly extending relation between the user's wrist and the user's elbow, wherein said two disconnected fins are disposed on opposite sides of a corresponding one of said arm sleeves, each of said two disconnected fins on said arm sleeves comprising a single longitudinal wall and a plurality of intersecting transverse walls, said longitudinal wall comprising a descending height toward the user's wrist, two leg sleeves disposable in a substantially covering relation to a portion of the user's feet and legs, each of said leg sleeves comprising a first, shoe portion and a second, leg portion, wherein said second, leg portion is disposable in an at least partially engaging relation with the user's calf, each of said leg sleeves further comprising at least one fin secured to said second, leg portion of said leg sleeve and disposable in an outwardly extending relation between the user's ankle and the user's knee, and wherein said fins disposed on said arm and leg sleeves are further structured and disposed to create multi-directional resistance when said aquatic exercise system is moved through a body of water.

9. The aquatic exercise system as recited in claim 8 wherein said plurality of intersecting transverse walls comprise descending heights toward the user's wrist.

10. The aquatic exercise system as recited in claim 9 wherein said leg sleeves each comprise two disconnected fins disposed on opposite sides of a corresponding one of said leg sleeves; each of said fins on said leg sleeves comprising a single longitudinal wall and a plurality of intersecting transverse walls; said longitudinal wall comprising a descending height toward the user's ankle.

11. The aquatic exercise system as recited in claim 10 wherein said plurality of intersecting transverse walls of said leg sleeves comprise descending heights toward the user's ankle.

* * * * *